United States Patent [19]

Peterson et al.

[11] Patent Number: 4,744,516

[45] Date of Patent: May 17, 1988

[54] AIR ASPIRATED COOLING FOR SPRAY GUNS

[75] Inventors: Gerald E. Peterson, St. Paul; Gary C. Polk, Eden Prairie; Richard W. Gunderson, Elk River; Warren J. Walsh, Waverly, all of Minn.; Ewald Kille, Friedrichshafen, Fed. Rep. of Germany

[73] Assignee: J. Wagner GmbH, Fed. Rep. of Germany

[21] Appl. No.: 768,212

[22] Filed: Aug. 22, 1985

[51] Int. Cl.[4] ..... B05B 1/24

[52] U.S. Cl. ..... 239/128; 239/332; 239/428.5; 417/372

[58] Field of Search ..... 239/128, 129, 288, 288.3, 239/288.5, 290, 294, 332, 428.5, 13; 417/372

[56] References Cited

U.S. PATENT DOCUMENTS

| | | | |
|---|---|---|---|
| Re. 20,058 | 8/1936 | Brever | 239/332 |
| 1,974,809 | 9/1934 | Dodge . | |
| 2,540,357 | 2/1951 | Stanley . | |
| 2,597,573 | 5/1952 | De Groff . | |
| 2,654,636 | 10/1953 | Duncan . | |
| 2,704,690 | 3/1955 | Eichenauer . | |
| 2,928,574 | 3/1960 | Wagner . | |
| 2,999,646 | 9/1961 | Wagner . | |
| 3,116,879 | 1/1964 | Wagner . | |
| 3,120,347 | 2/1964 | Duke, Jr. . | |
| 3,129,892 | 4/1964 | Tillman . | |
| 3,255,967 | 6/1966 | Kenney | 239/332 |
| 3,263,934 | 8/1966 | Hope, Jr. et al. . | |
| 3,445,063 | 5/1969 | Wagner . | |
| 3,565,344 | 2/1971 | Takei . | |
| 3,581,997 | 6/1971 | Stevenson . | |
| 3,599,876 | 8/1987 | Kyburg . | |
| 3,647,142 | 5/1972 | Drude et al. . | |
| 3,680,789 | 8/1972 | Wagner . | |
| 3,814,329 | 6/1974 | Clark . | |
| 3,899,134 | 8/1975 | Wagner . | |
| 3,952,955 | 4/1976 | Clements . | |
| 4,036,438 | 7/1977 | Soderlind et al. . | |
| 4,347,984 | 9/1982 | Sickles . | |
| 4,551,037 | 11/1985 | Kille et al. . | |
| 4,620,669 | 11/1986 | Polk . | |

FOREIGN PATENT DOCUMENTS

| | | |
|---|---|---|
| 1177565 | 9/1964 | Fed. Rep. of Germany . |

*Primary Examiner*—Andres Kashnikow
*Assistant Examiner*—Michael J. Forman
*Attorney, Agent, or Firm*—Hill, Van Santen, Steadman & Simpson

[57] ABSTRACT

There is disclosed herein a liquid spray gun which includes an improved heat dissipation system and an improved leakage flow recirculating system.

The improved heat dissipation system results from an improved and stronger air flow through the gun housing and around the electromagnetic coils. The improved air flow is created by a venturi or aspiration effect at the spray tip created by the action of the piston pump in spraying liquid at high velocity reducing the air pressure adjacent the tip. The internal portion of the housing communicates with the low pressure area so air in the housing is drawn from the housing to the low pressure area. Vents are provided in the housing adjacent the electromagnetic coils for outside air to be drawn into said housing over said coils and to the low pressure area, thus improving air flow and heat dissipation.

13 Claims, 3 Drawing Sheets

AIR ASPIRATED COOLING FOR SPRAY GUNS

BACKGROUND OF THE INVENTION

This invention relates to liquid spray devices, and more particularly, to liquid-atomizing spray guns which employ an AC-oscillator, electromagnet-driven piston pump.

One form of liquid-atomizing spray guns includes an electromagnet having an oscillating armature for driving a piston-pump which draws the liquid from a reservoir and forces the liquid through a spray tip.

Present guns are limited in the electric power they can utilize by various heat dissipation factors. Heat is generated in the electromagnetic coils and must dissipate by flowing through the coil bobbin and insulation tape and then be transferred to air in the housing. A portion of that heat is transferred through the gun housing walls and/or through convection vents in the top and bottom of the housing. The remaining heat is transmitted through the stator of the electromagnet to a heat sink that is cooled by convection of outside air.

It is an object of this invention to provide improved dissipation of heat generated by the electromagnetic coils.

Another object of this invention is to eliminate the heat sink.

A further object is to minimize operator fatigue in the use of the gun.

Yet another object is to reduce the manufacturing cost of the gun.

In piston pump spray guns, a small amount of liquid leaks around the piston. This liquid exits the pump from a collection port and is collected. The leakage flow may be returned to the liquid reservoir for recycling or may be collected in a separate cup or container.

It is another object of this invention to more efficiently recycle the leakage flow without returning the flow to the liquid reservoir.

A further object of the invention is to recycle the leakage flow from a collection cup.

These and other objects of this invention will become apparent from the following disclosure and appended claims.

SUMMARY OF THE INVENTION

There is provided by this invention a spray gun which exhibits improved heat dissipation and includes an improved leakage flow recycling system.

The improved heat dissipation results from an improved and stronger air flow through the housing and around the coils. The improved air flow is created by a venturi or aspiration effect at the spray tip where the action of the piston pump in spraying liquid at a high velocity reduces the air pressure adjacent the tip. The internal portions of the housing communicate with the low pressure area so that air in the housing is drawn from the housing into the low pressure area by a venturi or aspiration effect. Vents are provided in the housing adajcent the electromagnetic coils so as to permit outside air to be drawn into said housing, over said coils and to the low pressure area, thus improving air flow and heat dissipation. In addition, the coil bobbin and insulating tape are made from minimum R value materials to enhance heat flow from the coil to the air.

In another embodiment, additional air flow openings are provided in the spray tip for drawing outside air into the spray tip for assisting in cleaning the nozzle. Furthermore, a flapper-type fan may be provided on the armature of the electromagnetic drive for providing additional air flow into the housing.

The heat sink can now be eliminated reducing the weight of the gun, improving weight distribution, and reducing operator fatigue. In addition, the cost of the gun is reduced. Moreover, the efficiency of the gun has been significantly increased and heat build-up in the gun reduced.

Furthermore, the gun is provided with a two-position valve that in one position permits flow between the liquid reservoir and piston pump, and, in the other position, permits flow between the leakage reservoir and the piston pump. This valve permits the user to periodically empty the leakage flow reservoir and recycle the leakage flow directly back to the pump for spraying.

DESCRIPTION OF THE PREFERRED EMBODIMENT

Figure 1:
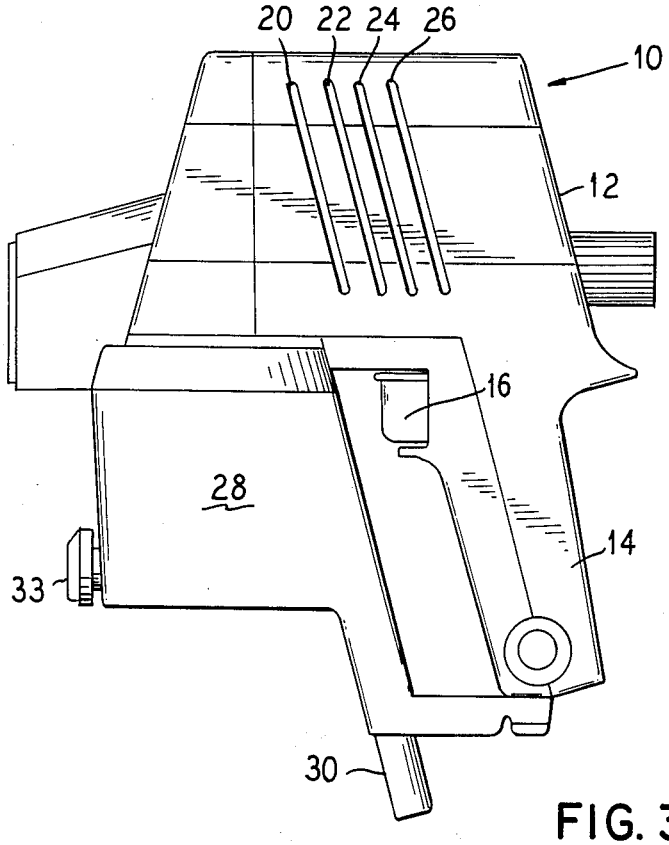
FIG. 1 is a side elevational view of the spray gun of this invention.
Figure 2:
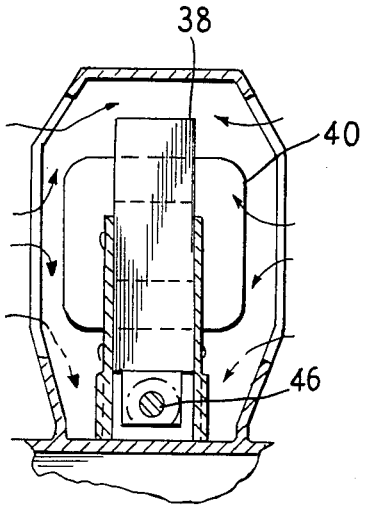
FIG. 2 is a cross-sectional view taken through the housing and showing the air flow path over the electromagnet coils and stator.

Referring to the drawings, there is shown in FIG. 1, a spray gun 10 generally, which includes a housing 12 that defines a depending handle 14 with activating switch 16 and the spray tip end 18. Four elongated air entry vents, such as 20, 22, 24 and 26, are provided in each side of the housing and are generally aligned with the location of the electromagnetic motor. The gun also includes a leakage reservoir area 28 forward of the handle and a depending tube 30 for connecting the gun to a liquid reservoir (not shown), which is usually filled with paint, such as a paint can. The two-position valve 32 (seen in FIG. 5) for selecting flow from the liquid reservoir or leakage reservoir includes a selector knob 33. An adjustor knob 34 provides for threaded adjustment of the throw of the armature for the electromagnetic motor and thus adjustment of the spray.

Figure 5:
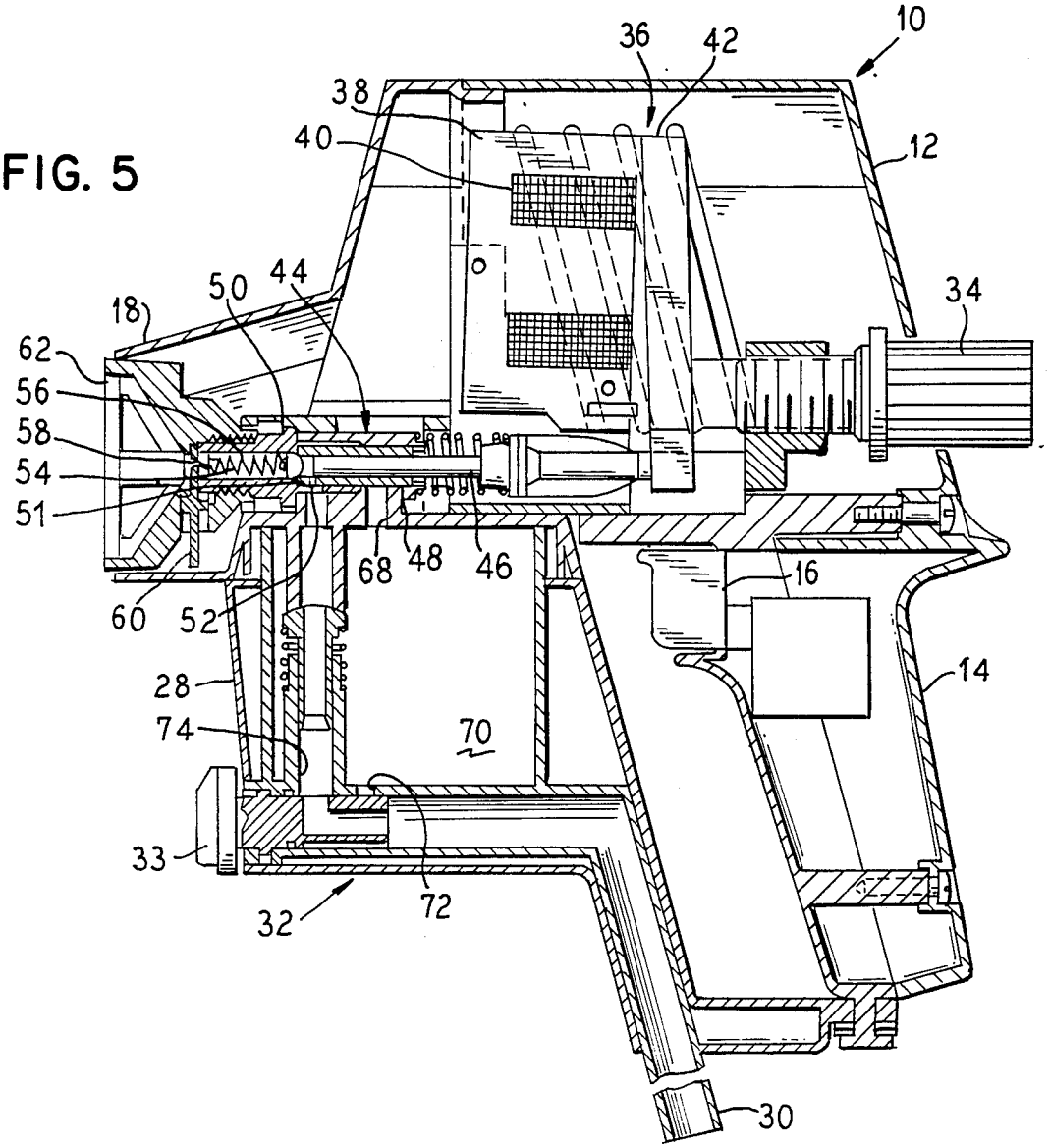
FIG. 5 is a longitudinal cross-sectional view showing the electromagnetic motor, piston pump, two-position valve and other internal parts.
Figure 6:
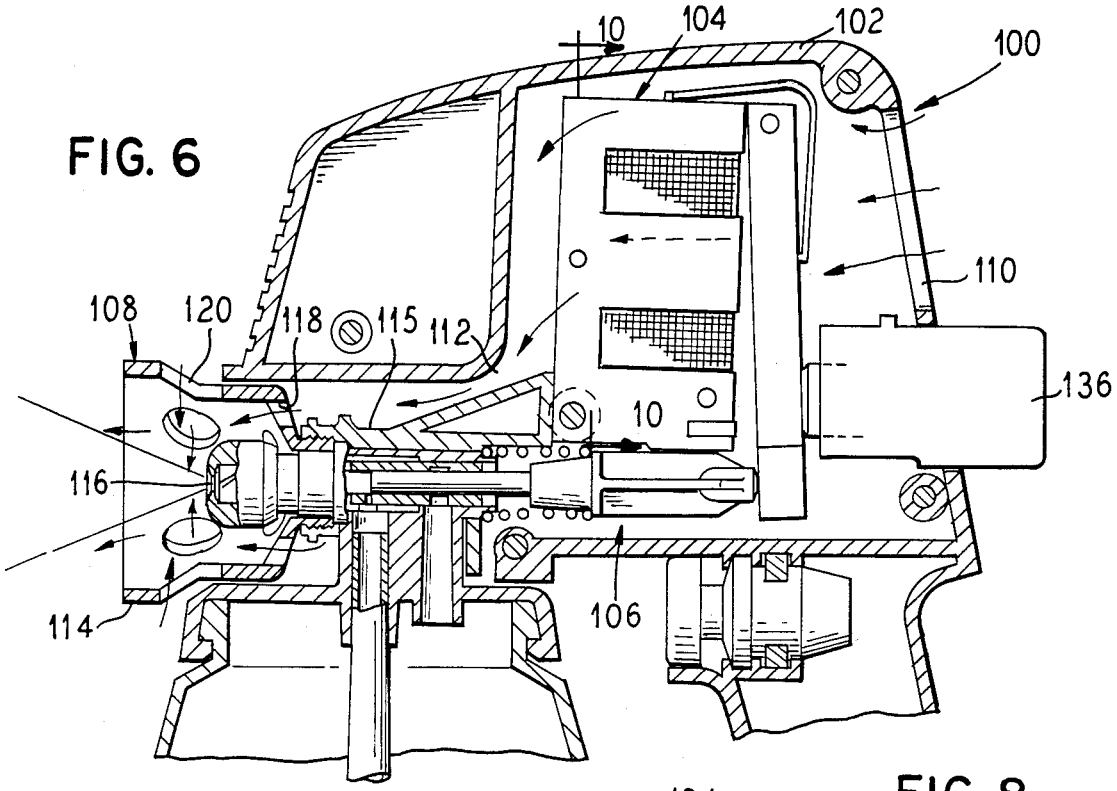
FIG. 6 is a sectional view of a second embodiment for the gun and shows the additional openings in the spray tip.
Figure 7:
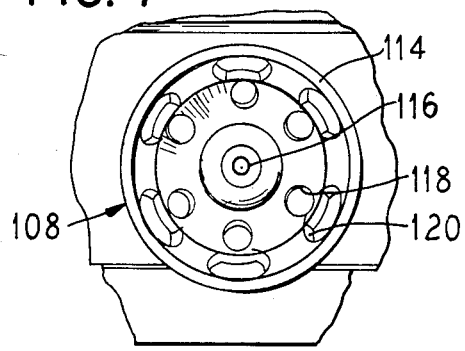
FIG. 7 is a front elevational view of the spray tip showing the additional air flow openings.
Figure 8:
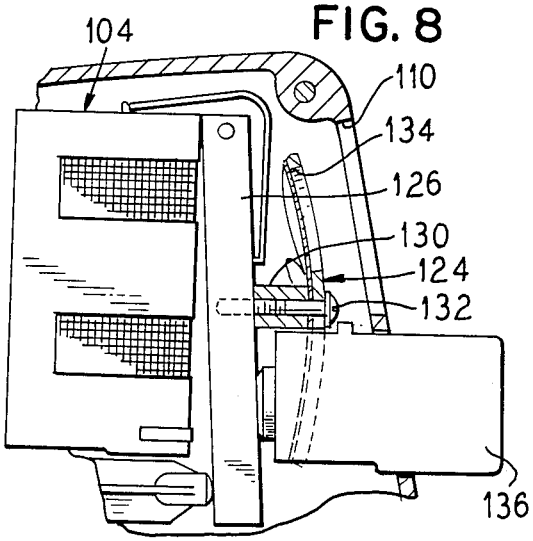
FIG. 8 is a sectional view of the back portion of the gun showing a flapper-type fan mounted to the electromagnetic drive.

Referring now to FIG. 5, the gun 10 includes an AC electromagnetic motor 36 which includes a stator 38 having a coil 40 wound thereabout. An oscillating armature 42 is pivotally mounted to said housing for movement toward and away from the stator in accordance with the AC cycle. The adjuster 34 limits the throw or movement of the armature away from the stator by engaging one side of the armature 42.

The armature 42 engages the piston pump 44 generally and operates the pump as it oscillates.

The piston pump includes an elongated piston rod 46 which is biased against the armature 42 and is mounted in a cylinder sleeve 48. The cylinder sleeve 48 is mounted in a sleeve housing 50 that is mounted to the gun. The cylinder sleeve 48 includes, adjacent the outlet end 51, a liquid inlet port 52.

The outlet end 51 defines a seat for a ball-check valve 54 which is mounted in a bore 56 that communicates with the spray nozzle 58. In this gun the nozzle is selectable from a plurality of nozzles in a rotatable wheel 60.

Figure 3:
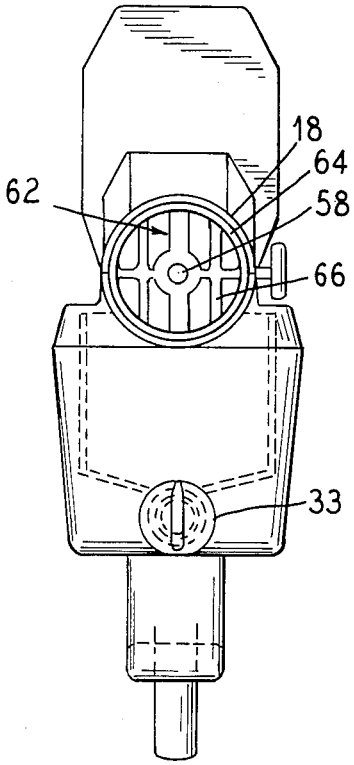
FIG. 3 is a front elevational view of the gun.

The nozzle 58 is at the center of the open mesh-like ribbed spray tip structure 62 which is best seen in FIG. 3. The structure 62 has a circular periphery 64 that fits into and is surrounded by the front end or shroud portion of housing 12 and also has interconnecting ribs or struts such as 66. This open network of ribs or struts permits air flow from the housing interior through the tip to the exterior.

The housing which supports the piston pump sleeve includes a leakage port 68 through which leakage flow exits the pump and is accumulated in leakage reservoir or chamber 70. The leakage reservoir 70 is provided with a bottom outlet port 72.

Communication between the liquid reservoir (not shown) and piston pump 44 is via liquid reservoir line 30, through the two-way valve 32, and through inlet line 74 that communicates with the inlet port 52. It will be noted that at the valve, the lines 30 and 74 are oriented at right angles to each other.

The valve 32 has a valve body which slidably and sealingly fits into the line 30 with its terminal end extending past the leakage reservoir outlet port 72. The body includes an L-shaped bore 76 that has an axial leg **76*a* and a radial leg 76*b*. The body also includes a flat land portion 78 in the side opposite the radial leg 76*b***.

In order to draw liquid from the reservoir, the valve is positioned as in FIG. 5 with the axial leg communicating with line 30 and the radial leg with line 74. Flow is thus from the reservoir, through the valve body and to the inlet line.

Figure 4:
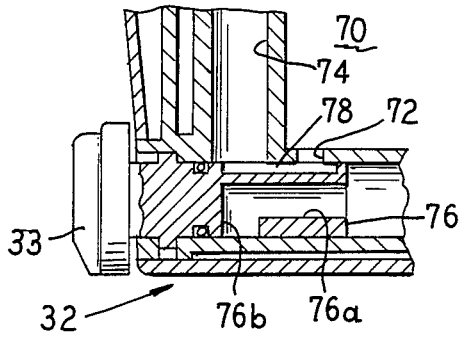
FIG. 4 is an enlarged view showing the two-position valve.

To empty the leakage reservoir 70, the valve 32 is rotated 180° from the liquid reservoir position of FIG. 5 to the leakage reservoir position of FIG. 4. In the leakage reservoir position, leakage liquid is drawn from reservoir 70, through outlet 72, along valve land 78, into inlet line 74 and to piston pump 44. After the reservoir 70 is empty, the two-way valve 32 is rotated back to the liquid reservoir position of FIG. 5 so as to draw liquid from the liquid reservoir to the pump 44.

In operation, the gun is activated by squeezing trigger switch 16 which activates the electromagnetic motor 36 and the oscillating armature 42, which in turn causes the piston pump to reciprocate. This delivers liquid at a high velocity to the nozzle 58 for spraying. The liquid exiting the nozzle and being sprayed creates a low pressure area at the spray tip 18 and forwardly of the nozzle 58.

With respect to cooling, this low pressure area draws air from outside the housing into the housing via the side vents such as 20, 22, 24 and 26. This air is drawn over the electromagnetic motor 36 and coil 40, transferring heat from the motor and coil by convection. The heat-containing air is then drawn from the motor through the front portion of the housing and exits the housing through the ribbed spray tip 18. Thus the low pressure area created by the spraying is used to aspirate or draw external air over the motor, through the housing and through the spray tip. With respect to the coil 40, the bobbin and insulating tape are made of materials which have a low R value and readily conduct heat to the flowing air.

Turning now to the second embodiment shown in FIGS. 6–9, there is shown a spray gun 100, having a housing 102, electromagnetic drive 104, an oscillating pump 106 and spray tip 108.

The housing 102 includes vents 110 formed in the rear of the housing and a shaped air flow pasasage 112 between the electromagnetic motor 104 and the spray tip 108.

The tip 108 structure includes a threaded 114 which is mounted to the gun bracket 115 and surrounds the nozzle 116. The threaded end acts as a nut to hold the pump 106 in place in the bracket 115 and in the gun. The structure includes rear air flow openings 118 through which air from the interior of the gun flows and side openings 120 through which air from the outside flows into the structure interior. It is believed that air entering through the side openings assists in keeping the nozzle structure clean and unclogged. Air entering the structure from the interior of the gun represents less than about 70% of the air flow entering the structure interior. Air entering the structure interior from outside the gun represents more than about 30% of the air flow entering structure interior.

Figure 9:
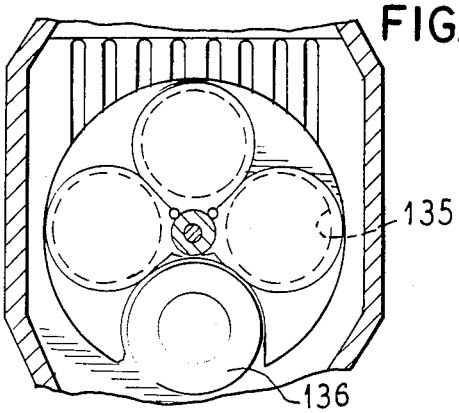
FIG. 9 is a rear elevational view showing the flapper fan.

Additional air flow is provided by a flapper fan 124, which is mounted to the armature 126 of the electromagnetic drive 104. As the armature oscillates, the fan is moved and draws outside air into the gun via vents 110. The fan includes a flapper assembly 128 that is mounted to the armature by the spacer 130 and screw 132. The flapper assembly includes a body 134 in which apertures 135 are cut and a flapper valve member or membrane 136 positioned against the body 134 between the body 134 and mount 130. As the fan moves toward the housing vents 110, the valve opens and air flows through the aperture 135 into the interior of the gun. As the fan moves toward the drive 104, the valve closes and the fan drives air into the interior of the gun. Referring now to FIG. 9, it is seen that the lower portion of the fan is cut out so as to accommodate the adjuster knob 136.

Figure 10:
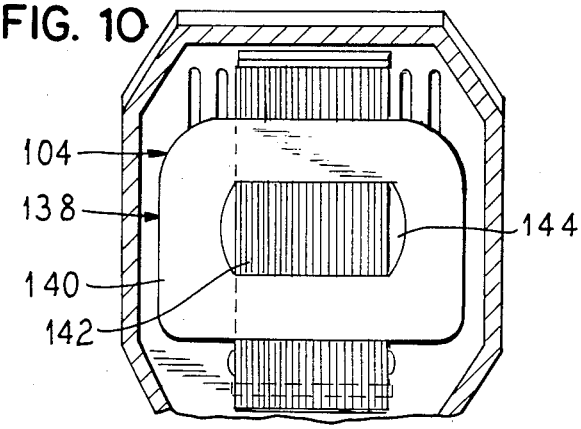
FIG. 10 is a sectional view taken along line 10—10 of FIG. 6 and showing the electromagnetic stator and coil.

The stator 138 for the electromagnetic drive is shown in FIG. 10. The stator includes the bobbin 140 having a coil 142 wrapped therearound. It is seen that gaps such as 144 are provided for air flow through the stator so as to provide additional cooling for the drive. Thus, air flows both around and now through the drive 104.

Although the invention has been described with respect to preferred embodiments, it is not to be so limited as changes and modifications can be made which are within the full intended scope of the invention as defined by the appended claims.

We claim as our invention:

1. A high pressure paint spray gun which includes:

a gun-like housing;

a spray tip at one end of the housing, said spray tip including a liquid atomizing spray nozzle having a spray pattern and a ribbed open-mesh spray structure about said nozzle and opening into said housing, said structure having a larger diameter downstream of the nozzle such that said structure lies substantially outside of the spray pattern from the nozzle;

housing associated wall means radially spaced from said nozzle substantially encircling said nozzle and extending downstream therefrom defining an area open to an interior of the housing, said wall means being substantially outside the spray pattern;

pump means in said housing for delivering a liquid under high pressure to said nozzle for spraying at a high velocity;

electric motor means in said housing for driving said pump means, said motor means generating heat during operation;

vent means formed in said housing adjacent said electric motor means;

whereby during spraying said liquid is sprayed at a high pressure and is atomized and creates a low pressure area forward of and adjacent said spray tip interior of said wall means, which cooperates in drawing air through said vents, over said electric motor means, through said housing and around said spray tip interior of said wall means, so as to aid in cooling said electric motor means.

2. A gun as in claim 1, wherein said vent means are provided in each side of said housing.

3. A gun as in claim 2, wherein said vent means comprise a plurality of elongated slots.

4. A gun as in claim 1, wherein said wall means are a portion of said gun housing at said spray tip end and in surrounding relationship to said spray tip so as to provide an air flow relationship from said housing through said spray tip.

5. A gun as in claim 1, wherein said nozzle is centrally located in said tip and said ribs define said open-mesh spray structure and surround said nozzle.

6. A gun as in claim 1, wherein said electric motor is electromagnetic and includes an oscillating armature and a stator and coil assembly wherein during operation during coil generates heat which is to be dissipated.

7. A gun as in claim 6, wherein said pump is a piston pump.

8. A gun as in claim 7, wherein said piston pump includes a piston rod which is drivingly engaged by said armature for reciprocating said rod.

9. A piston pump spray gun which comprises:

a housing having a depending handle;

an electromagnetic motor with an oscillating armature in said housing;

a switch in said handle for controlling current flow to said motor;

spray tip means adjacent an end of said housing for spraying a liquid therefrom;

piston pump means operatively associated with said oscillating armature for delivering said liquid to said spray tip at a high pressure; and means for air cooling said electromagnetic motor including:

vent means in said housing adjacent said electric motor;

said spray tip means including structure means mounted thereon, said structure means having a plurality of spaced guard struts which permit air flow from the interior of said housing through said struts to the area around said tip means;

said housing being constructed so as to provide an air flow passage between said electromagnetic motor and said spray tip means;

whereby liquid exiting said spray tip means at a high velocity causes a pressure drop adjacent said tip means, thus drawing cooling air through said vents, across said electromagnetic motor, through said housing and through the open spaces defined by the struts in the guard means.

10. An airless spray gun comprising a housing, an electric motor inside the housing having a driven moving element, a piston pump operatively associated with said housing having a piston driven by said driven moving element, a liquid feed inlet to said pump for feeding liquid to said pump, a spray tip associated with said piston pump for atomizing and discharging liquid pumped by said pump, said discharged liquid having an expanding spray pattern, said housing having a forward end, said spray tip positioned adjacent said forward end of said housing, said forward end having housing wall portions surrounding said spray tip in spaced relation therefrom and projecting distally of said spray tip whereby said spray tip is recessed within said housing wall portions, an internal clearance area between said spray tip and an interior of said forward end of said housing defined by said wall portions, said clearance area being of substantially a larger cross-sectional area than the cross-section of the spray pattern at all axial dimensions of the spray pattern which are within the clearance area, air openings in said housing positioned with respect to said motor and spray tip such as to allow an air flow from said air openings past said motor and past said spray tip and out of said forward end opening, and liquid dispensed through said spray tip creating a venturi suction effect in said internal clearance area interior of said forward end drawing air from said openings past said motor and spray tip expelling said air from said housing out of said opening at the forward end of the housing along with said spray pattern.

11. The spray gun of claim 10 wherein said spray tip is received in a nozzle guard member and said nozzle guard member is received interiorly of said housing in close spaced relation to said housing wall portions, said nozzle guard having openings therethrough defining air flow passageways for drawing air by said venturi suction effect.

12. An airless spray gun comprising a housing, an electric motor inside said housing having a driven moving element, a pump means operatively associated with said housing having a liquid compressing and propelling means driven by said motor, a liquid feed inlet to said pump, atomizing spray tip means associated with said pump for atomizing a liquid pumped by said pump, said spray tip having an atomizing orifice, wall means radially spaced from said orifice and extending downstream therefrom at least partially encircling said orifice and defining an area, said wall means defined area having a forward end having an internal dimension greater than a major diameter dimension of a substantial body portion of the pattern of spray from said orifice at said forward end, said area open to an interior of said housing, said pump and orifice combining to eject liquid from said orifice at a high pressure-velocity to cause a pressure drop in said area to draw air into said area from the interior of said housing, vent opening in said housing positioned with respect to said motor to admit air to the interior of said housing from the exterior thereof to be drawn through said housing to said area and effective to cool said motor, said air being ejected from said area with said spray pattern.

13. An airless paint spray gun comprising a housing, said housing having a front, a motor located in an interior of said housing, a pump driven by said motor, a paint atomizing nozzle adjacent a front of the housing, housing wall portions surrounding said nozzle and extending forwardly of said nozzle terminating in an open end at the front of said housing having an open interior dimensioned greater than a pattern of spray from said nozzle, the housing wall portion defining a substantially circumferentially enclosed area around and forward of said nozzle open to the interior of the housing, said pump ejecting paint from said nozzle at a high pressure-velocity whereby a venturi suction pressure drop exists in said substantially circumferentially enclosed area adjacent said spray pattern radially of said nozzle, vents in said housing positioned with respect to said motor and said nozzle such that said venturi causes an air flow from the exterior of said housing through said vents past said motor beyond said nozzle in said area and out said opening, said air flow effective to cool the interior of said housing, and means for removing said nozzle from said housing through said opening.

* * * * *